US007819142B2

(12) United States Patent
Puissant

(10) Patent No.: US 7,819,142 B2
(45) Date of Patent: Oct. 26, 2010

(54) METHOD FOR INTRODUCING A WEFT THREAD IN AN AIR WEAVING MACHINE AND AIR WEAVING MACHINE

(75) Inventor: Patrick Puissant, Merelbeke (BE)

(73) Assignee: Picanol N.V., Ypres (BE)

( * ) Notice: Subject to any disclaimer, the term of this patent is extended or adjusted under 35 U.S.C. 154(b) by 0 days.

(21) Appl. No.: 12/084,900

(22) PCT Filed: Nov. 20, 2006

(86) PCT No.: PCT/EP2006/011106

§ 371 (c)(1),
(2), (4) Date: Nov. 15, 2008

(87) PCT Pub. No.: WO2007/057217

PCT Pub. Date: May 24, 2007

(65) Prior Publication Data

US 2009/0120524 A1 May 14, 2009

(30) Foreign Application Priority Data

| | | |
|---|---|---|
| Nov. 21, 2005 | (BE) | 2005/0566 |
| Feb. 24, 2006 | (BE) | 2006/0122 |
| Mar. 8, 2006 | (BE) | 2006/0148 |

(51) Int. Cl.
*D03D 47/30* (2006.01)
*D03D 49/50* (2006.01)

(52) U.S. Cl. ..... 139/435.1; 139/116.1; 139/435.6; 139/435.5; 139/435.4; 139/435.3

(58) Field of Classification Search ..... 139/116.1, 139/435.1–435.6
See application file for complete search history.

(56) References Cited

U.S. PATENT DOCUMENTS

| | | | | |
|---|---|---|---|---|
| 3,705,608 | A | 12/1972 | Vermeulen | |
| 4,262,707 | A | 4/1981 | Suzuki | |
| 4,501,008 | A * | 2/1985 | Rosseel et al. | 377/2 |
| 4,703,779 | A * | 11/1987 | Philippe et al. | 139/435.5 |
| 4,756,342 | A * | 7/1988 | Van Bogaert | 139/435.3 |
| 4,759,392 | A * | 7/1988 | van Bogaert et al. | 139/435.2 |
| 4,813,460 | A * | 3/1989 | Van Bogaert et al. | 139/435.4 |
| 4,817,675 | A * | 4/1989 | Dewaele et al. | 139/35 |
| 4,832,091 | A * | 5/1989 | Shaw | 139/450 |
| 4,834,145 | A * | 5/1989 | Lewyllie et al. | 139/429 |
| 4,850,398 | A * | 7/1989 | Van Bogaert | 139/435.1 |
| 4,898,214 | A * | 2/1990 | Lewyllie et al. | 139/116.2 |

(Continued)

FOREIGN PATENT DOCUMENTS

CN 1605669 A 4/2005

(Continued)

OTHER PUBLICATIONS

Official Action of Chinese Patent Office regarding Chinese Patent Application No. 200680043396.1, Jun. 11, 2010.

*Primary Examiner*—Bobby H Muromoto, Jr.
(74) *Attorney, Agent, or Firm*—Bacon & Thomas, PLLC

(57) ABSTRACT

Method for introducing a weft thread in an air weaving machine, wherein the instant when the supply of compressed air to a set or sets of auxiliary blowers is interrupted is controlled based on measurements on the transported weft thread during transport of this weft thread.

22 Claims, 12 Drawing Sheets

U.S. PATENT DOCUMENTS 4,901,772 A * 2/1990 Van Bogaert et al. ..... 139/452
4,905,737 A * 3/1990 Gryson ..... 139/35
4,909,283 A * 3/1990 Verclyte ..... 139/1 C
4,909,285 A * 3/1990 Van Bogaert et al. ..... 139/450
4,909,286 A * 3/1990 Decock et al. ..... 139/452
4,926,911 A * 5/1990 Shaw ..... 139/435.1
4,938,268 A * 7/1990 Shaw ..... 139/116.2
4,947,898 A * 8/1990 Ampe et al. ..... 139/452
4,953,597 A * 9/1990 Van Bogaert et al. ..... 139/452
4,962,793 A * 10/1990 Dussart et al. ..... 139/116.2
4,964,442 A * 10/1990 Tacq et al. ..... 139/452
4,967,801 A * 11/1990 Gryson ..... 139/35
4,967,807 A * 11/1990 Lewyllie et al. ..... 139/452

FOREIGN PATENT DOCUMENTS

EP 0 554 222 A1 8/1993
JP 60-162838 8/1985

* cited by examiner

METHOD FOR INTRODUCING A WEFT THREAD IN AN AIR WEAVING MACHINE AND AIR WEAVING MACHINE

BACKGROUND

A. Field of the invention

The invention relates to a method for introducing a weft thread in an air weaving machine. The invention also relates to an air weaving machine for applying a method of this type.

B. Related Technology

Air weaving machines in which compressed air is supplied to a number of blowers in order to transport a weft thread through a shed are known. In these machines, one or more main blowers and a number of auxiliary blowers are provided for the purpose of transporting a weft thread through a shed via an air-guiding passage. Weaving machines of this type include a supply device for supplying compressed air to blowers of this type. Supplying compressed air to a set of auxiliary blowers is effected, for example, by actuating a shut-off valve which is disposed between a buffer reservoir containing compressed air at a specific pressure and the set of auxiliary blowers for a certain period of time.

It is known from U.S. Pat. No. 3,705,608 to supply compressed air successively to the successive auxiliary blowers as the weft thread moves through the shed. It is known from U.S. Pat. No. 4,262,707 to select the period during which compressed air is supplied to the respective successive auxiliary blowers to be progressively longer in the direction of movement of the weft thread. This has the advantage that both a fast weft thread and a slow weft thread are sufficiently supported by compressed air coming from successive auxiliary blowers.

It is known from EP 0 554 222 A to provide at least one detector for detecting the arrival of the leading end of an inserted weft thread at a weft detector. Hereby the fluid injection from any of the auxiliary blowers is compensated as required in order to accelerate or to decelerate the weft thread such that the weft thread will timely arrive at the end of the shed opposite the main nozzles.

SUMMARY OF THE INVENTION

It is an object of the invention to provide a method and an air weaving machine which make it possible to reduce the amount of air which is used for introducing weft threads into a shed.

For this purpose, a method according to the invention comprises controlling the instant when the supply of compressed air to a set of auxiliary blowers is interrupted depending on measurements on the transported weft thread during transport of this weft thread.

This method according to the invention has the advantage that when a fast weft thread is transported, the supply of compressed air to a set of auxiliary blowers can be interrupted sooner than is the case when a normal or slow weft thread is transported, so that the supplied amount of compressed air and the air consumption is reduced. This is possible because, at the point in time when the weft thread has already passed the respective set of auxiliary blowers, the supply of compressed air to a weft thread essentially no longer contributes to the transport of the weft thread through the shed and thus essentially does not contribute to the movement of the weft thread. In addition, compressed air supplied in this manner essentially does not contribute to stretching of such a weft thread. The method according to the invention has virtually no effect on normal or slow weft threads. In this case, the auxiliary blowers will be actuated in the standard manner and the supply of compressed air to the respective auxiliary blowers will not be interrupted early.

According to an embodiment, the supply of compressed air to a set of auxiliary blowers is interrupted a certain period of time after a weft thread has arrived at a specific set of auxiliary blowers. This allows a reduction in the consumption of air without the risk of any adverse effect on the transport of the weft thread.

According to an embodiment, the method comprises setting and/or adjusting and/or automatically setting and/or automatically adjusting an instant which allows the interruption for a certain percentage of the insertions to take place sooner than for other insertions. Providing such an instant makes it possible to apply the method according to the invention in a simple manner. In this case, this instant can be determined in relation to a mean instant when a weft thread arrives at a thread monitor, for example this instant may be determined as a percentage relative to a mean instant when a weft thread arrives at a thread monitor. This percentage may depend on the set manner of influencing the supply of compressed air to a set of auxiliary blowers, more particularly if a strong, medium or limited influence is chosen.

According to one embodiment, the method comprises setting the manner of influencing the supply of compressed air to a set of auxiliary blowers. The method may use an amplification factor and/or a set percentage and/or a set value and/or a measured time difference and/or an amplification factor in function of the speed of the weaving machine. The method may control the instant when the supply of compressed air to a set of auxiliary blowers is interrupted depending on a variation in measurements on a plurality of transported weft threads during transport of these weft threads.

The method according to the invention is particularly suitable for use with fast-running weaving machines. In addition, such a method offers numerous advantages which will be described in more detail below.

The invention also relates to an air weaving machine which uses an abovementioned method.

DESCRIPTION OF THE DRAWINGS

Further characteristics and advantages of the invention will emerge from the following description of the exemplary embodiments depicted in the drawings and from the subclaims. In the drawings:

DETAILED DESCRIPTION OF PREFERRED EMBODIMENTS OF THE INVENTION

Figure 1:
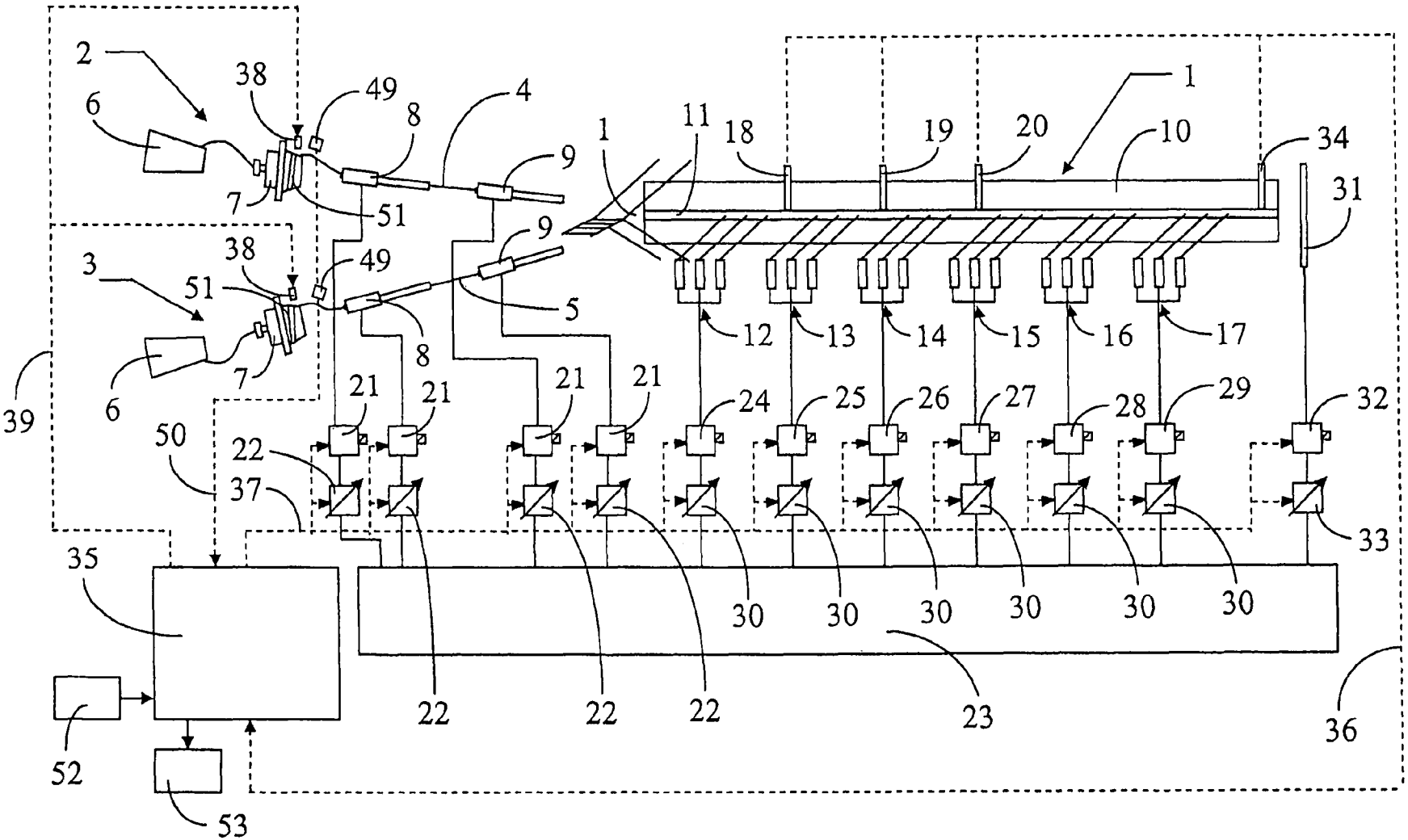
FIG. 1 diagrammatically depicts part of an air weaving machine according to the invention.

FIG. 1 shows a device for transporting a weft thread through a diagrammatically indicated shed 1 of an air weaving machine. This device has two supply channels 2, 3 for the supply of weft threads 4, 5. Each supply channel has a thread supply 6, a prewinder 7, a first main blower 8 and a second main blower 9. Furthermore, the air weaving machine has a reed 10 in which a guide passage 11 is provided which allows a weft thread to be transported through the shed 1 via this guide passage 11 with the aid of compressed air. Near this guide passage 11, successive sets of auxiliary blowers 12, 13, 14, 15, 16 and 17 are arranged in order to successively support a weft thread using compressed air. In addition, a plurality of thread monitors 18, 19 and 20 are arranged along the guide passage 11 in order to detect when a weft thread arrives at these thread monitors 18, 19 and 20, more particularly the leading end of the weft thread arrives at these monitors 18, 19 or 20. The thread monitors 18, 19 and 20 are arranged in the longitudinal direction of the guide passage 11 and at a certain distance after a set of auxiliary blowers 12, 13 and 14, respectively.

The main blowers 8 and 9 are connected to a compressed-air source 23 via associated shut-off valves 21 and throttle valves 22. Each set of auxiliary blowers 12, 13, 14, 15, 16 and 17 is analogously connected via a shut-off valve 24, 25, 26, 27, 28 and 29 and an associated throttle valve 30 to the compressed-air source 23. According to a variant (not shown), a separate compressed-air source may be provided for both the main blowers and the auxiliary blowers. In addition, a stretching blower 31 is shown which serves to keep a weft thread stretched once it has been introduced. The stretching blower 31 is connected to a compressed-air source 23 via a shut-off valve 32 and a throttle valve 33. At the end of the guide passage 11 which is situated opposite the end where the main blowers 9 are arranged, a thread monitor 34 is arranged which is able to determine when a weft thread 4, 5 arrives at this thread monitor 34.

The shut-off valves 21, 24, 25, 26, 27, 28, 29, 32 and the throttle valves 22, 30, 33 are controlled by a control unit 35 of the air weaving machine, as illustrated in FIG. 1. The thread monitors 18, 19, 20 and 34 in this case also cooperate with the control unit 35. The shut-off valves for example consist of electromagnetic valves which can be controlled by the control unit 35. The throttle valves can in this case also be designed such that they can be driven by a motor and controlled by the control unit 35.

A weft thread 4, 5 is blown into the guide passage 11 by the main blowers 8, 9 and is then blown further along the guide passage 11 by jets of air from the auxiliary blowers 12, 13, 14, 15, 16 and 17. The guide passage 11 is, for example, arranged in a reed 10 and is disposed in a known way in a shed during the introduction of a weft thread 4, 5. The main blower 9, the auxiliary blowers 12, 13, 14, 15, 16 and 17, the reed 10 and the thread monitors 18, 19, 20 and 34 are mounted in a known way on a sley (not shown) moving in a reciprocating fashion. The thread supply 6, the prewinders 7, the main blower 8 and the stretching blower 31 are mounted on a frame of the air weaving machine.

The thread monitors 18, 19, 20 and 34 are, for example, connected to the control unit 35 by means of a common connecting line 36. The shut-off valves 21, 24 up to 29, 32 and the throttle valves 22, 30, 33 are also connected to the control unit 35 by means of a common connecting line 37. Each prewinder 7 contains a magnetic. pin 38 in order to release a desired length of weft thread 4 or 5 at a suitable instant. The magnetic pins 38 are connected to the control unit 35 via a common connecting line 39.

Figure 2:
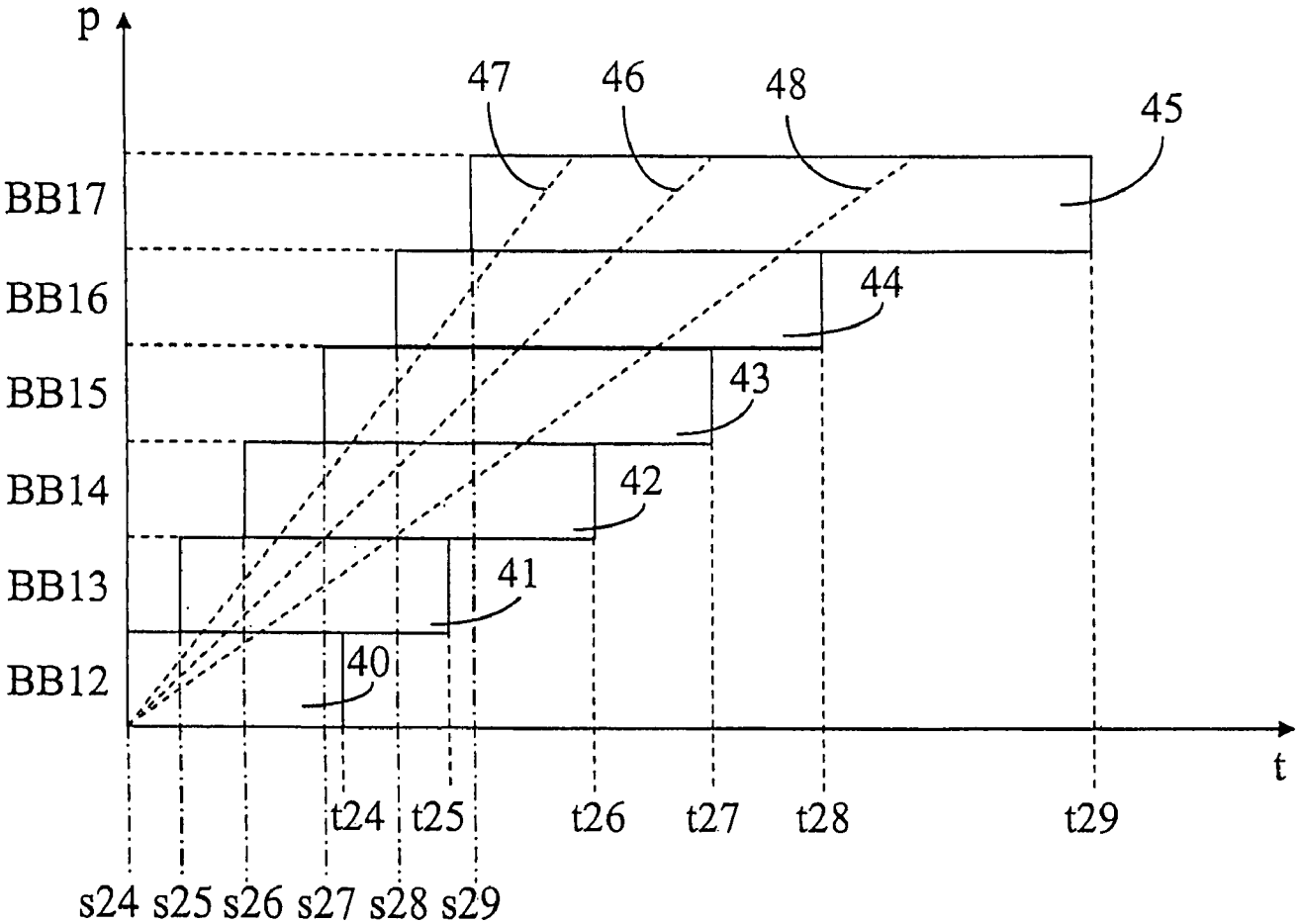
FIG. 2 shows a flowchart for the supply of compressed air to successive auxiliary blowers.

While a weft thread is being transported, the shut-off valves 24, 25, 26, 27, 28 and 29 are, for example, actuated according to the diagram as illustrated in FIG. 2. In this case, the shut-off valves 24, 25, 26, 27, 28, 29 are actuated in succession. These successive shut-off valves 24, 25, 26, 27, 28, 29 are also actuated in a known manner for a longer period of time the further away they are located from the main blowers 9. The shut-off valve 29 is actuated for a relatively long period of time in order to make it possible to restretch the weft thread after its introduction and to keep it stretched. For this purpose, according to a variant, a plurality of sets of auxiliary blowers can be actuated for a relatively long period of time, for example at least the last sets of auxiliary blowers 16 and 17. According to another variant, certain sets of auxiliary blowers can be actuated again at the end of the insertion in order to stretch a weft thread.

With air weaving machines, it is customary to weave at a weaving speed in the order of magnitude of 800 to 1200 weft threads per minute or, expressed differently, of 1400 to 2800 meters/minute. In this case, an insertion of a weft thread only takes a few tens of milliseconds. When weaving irregular weft threads, for example spun weft threads, it is possible that, with successive weft threads, a measured insertion parameter differs strongly from weft thread to weft thread. In this case, it is possible that a certain weft thread arrives at a thread monitor 18, 19 or 20 at a different point in time in the weaving cycle.

FIG. 2 shows, by means of blocks 40, 41, 42, 43, 44 and 45, in each case a period in which the auxiliary blowers 12, 13, 14, 15, 16 and 17, respectively, are supplied with compressed air, in other words, a period when the shut-off valves 24, 25, 26, 27, 28 and 29 are open in order to supply compressed air to an associated auxiliary blower. The block 40 starts at the instant s24 when the valve 24 is opened, to supply compressed air to a set of auxiliary blowers 12 via the valve 24 and ends at the instant t24 when the valve 24 is closed again and the supply of compressed air to the set of auxiliary blowers 12 is interrupted again. Analogously, the valves 25, 26, 27, 28 and 29 are opened at instants s25, s26, s27, s28 and s29 and closed at instants t25, t26, t27, t28 and t29, respectively.

In FIG. 2, line 46 illustrates the movement path of an average weft thread, line 47 the movement path of a fast weft thread and line 48 the movement path of a slow weft thread. It should be noted in this case, that the respective auxiliary blowers are actuated in time so that they are already actuated when a fast weft thread arrives and remain actuated sufficiently long until a slow weft thread arrives. Such a method requires a relatively high air consumption.

The method for introducing a weft thread with an air weaving machine according to the invention is explained in more detail with reference to FIG. 3. According to the invention, measurements are carried out on the transported weft thread 4, 5 while the weft thread 4, 5 is being transported. In the illustrated example, these measurements comprise measuring the instant t18, t19 and/or t20 when a weft thread 4, 5 respectively arrives at a thread monitor 18, 19, 20. The instant T26, T27 and/or T28 when the supply of compressed air to a set of auxiliary blowers 14, 15 or 16 is interrupted, is determined based on such measurements on the transported weft thread 4, 5.

According to one possibility, the instant T26 is determined as a period P26 in time following the instant t20. Analogously, the instant T27 can be determined as a period P27 following t20 and the instant T28 as a period P28 following t20. In this case, the supply of compressed air to at least one specific set of auxiliary blowers 14, 15, 16 is interrupted early. This early interruption occurs a specific period of time after a weft thread arrives at a thread monitor 20, the thread monitor 20 being positioned downstream of a specific set of auxiliary blowers 14.

In order to detect any possible wrong or inaccurate measurement at t20, it is determined whether the period between t18 and t19 substantially corresponds to half the period between t18 and t20. If this is not the case, then, for example, the respective instants t26, t27 and t28 for interrupting are retained and the supply of compressed air is not interrupted early at instants T26, T27 and T28 according to a method according to the invention. This prevents the supply of compressed air from being interrupted early on the basis of a wrong measurement.

Figure 3:
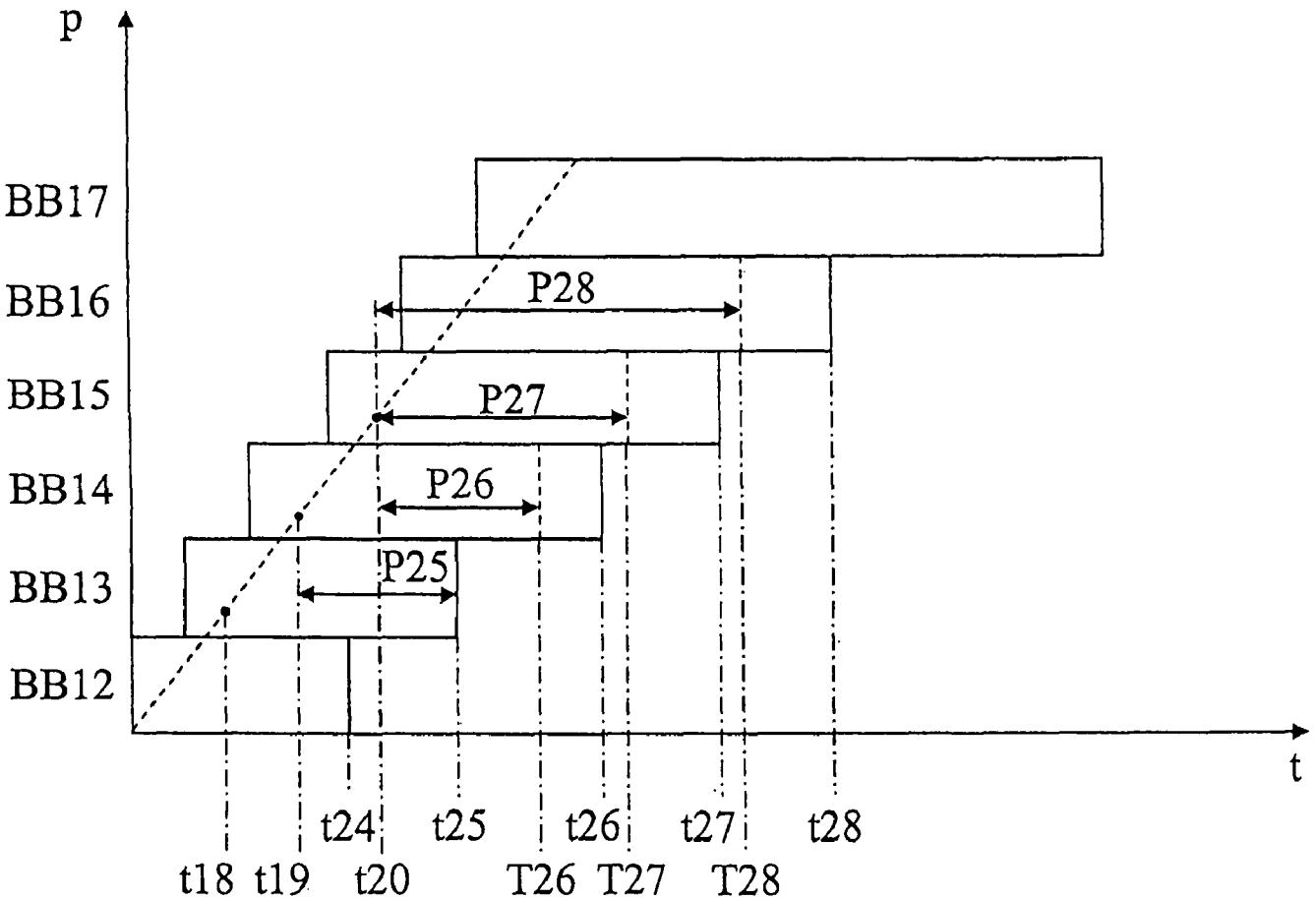
FIGS. 3 to 9 each show a flowchart for the supply of compressed air to successive sets of auxiliary blowers.
Figure 4:
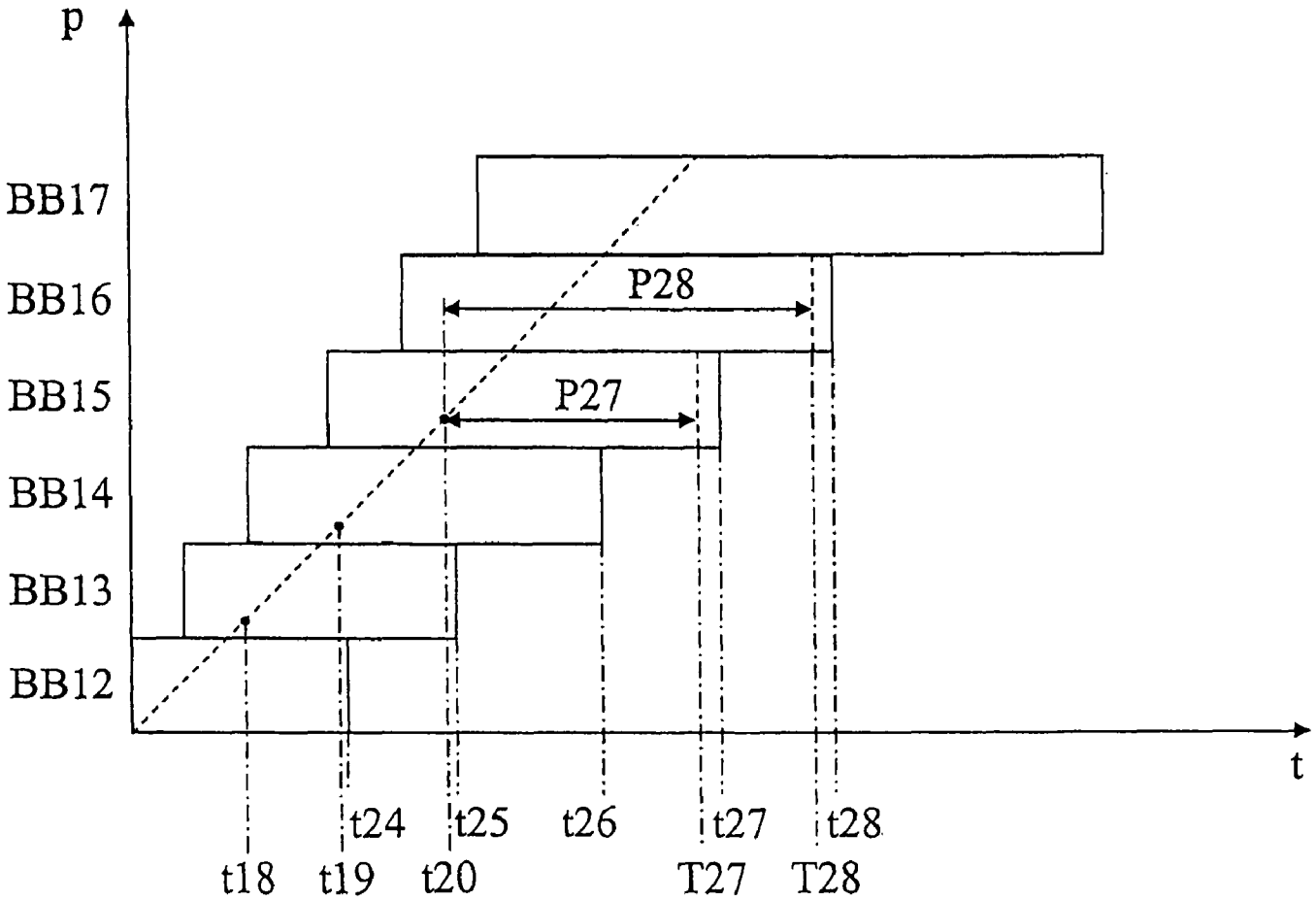

FIG. 4 shows a variant of FIG. 3, in which the weft thread is introduced slightly more slowly. In this case, the supply of compressed air is interrupted slightly later than with the embodiment of FIG. 3 and slightly sooner than with the embodiment of FIG. 2 according to the prior art. It is clear that if, according to the abovementioned method, the instant T26, T27 or T28 (determined as illustrated in FIG. 3) would come to lie after the instant t26, t27 or t28, the supply of compressed air would in this case still be interrupted at instants t26, t27 or t28. In this manner, the supply of compressed air is only interrupted early at a number of sets of auxiliary blowers 14, 15 and 16 for a sufficiently fast weft thread, while for a relatively slow weft thread, the instant of interrupting is not delayed. In the example of FIG. 4, the supply to the set of auxiliary blowers 14 is interrupted at the predetermined instant t26 and only the supply of compressed air to the sets of auxiliary blowers 15 and 16 is interrupted early at instants T27 and T28, in other words sooner than the predetermined instants t27 and t28 which are used for relatively slow weft threads.

Figure 5:
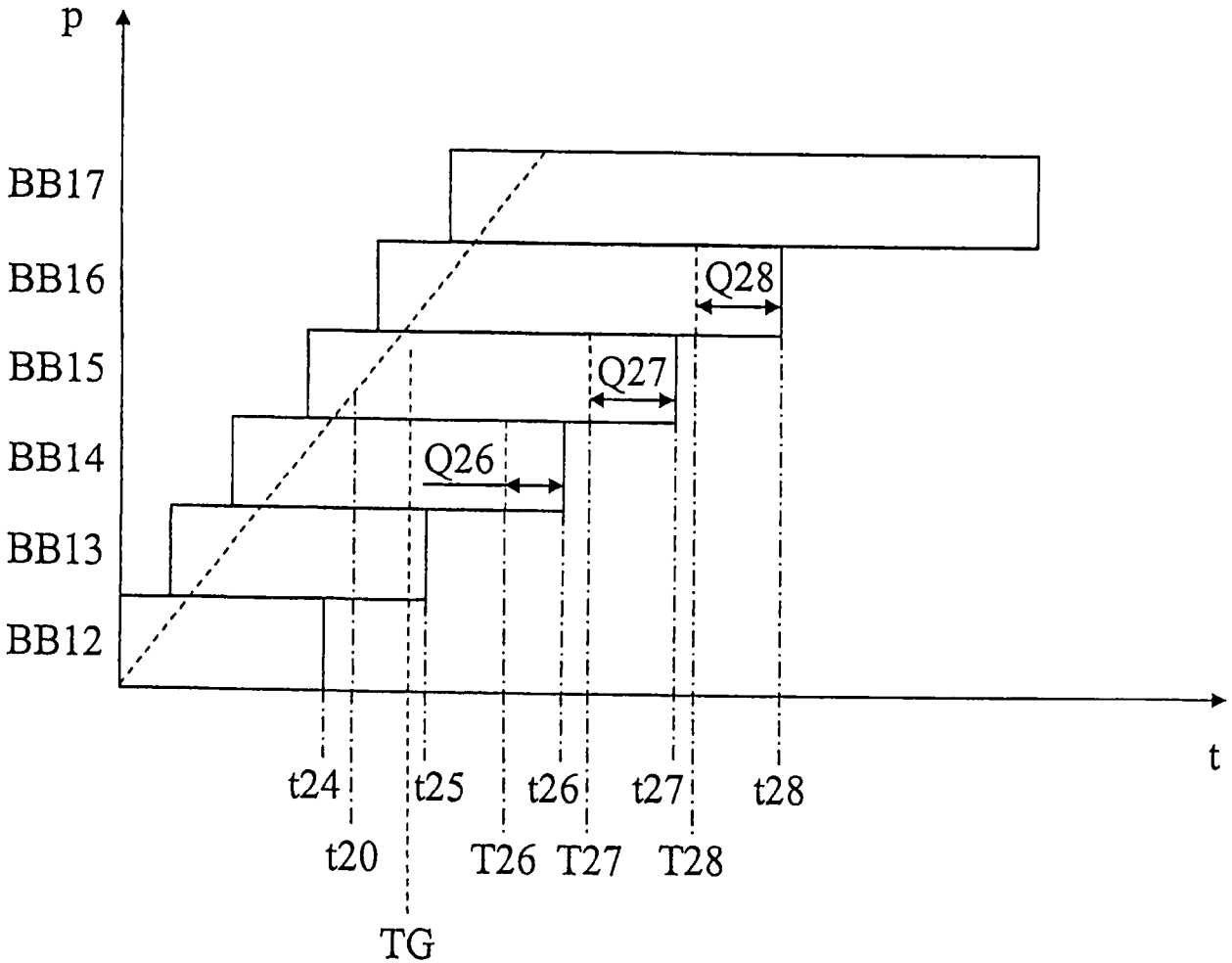

According to a variant shown in FIG. 5, in case t20 occurs before an instant TG in the weaving cycle, the supply of compressed air to the sets of auxiliary blowers 14, 15 and 16 is interrupted early at an instant T26, T27 and T28 when for example a predetermined period Q26, 027, Q28 takes place in time, respectively before the set instants t26, t27 or t28. In examples as illustrated in FIGS. 3 to 5, the supply of compressed air to the sets of auxiliary blowers 14, 15 and 16 is interrupted early, that is to say interrupted sooner than the normal or predetermined setting of the supply of compressed air to the sets of auxiliary blowers of the weaving machine as illustrated in FIG. 2. This makes it possible to save compressed air without transport and/or restretching of the weft thread being greatly affected.

Of course, it is also possible to interrupt the supply of compressed air to the sets of auxiliary blowers 12, 13 and 17 early in such a manner. As the set of auxiliary blowers 12 only blows for a short period of time, early interruption of the supply of compressed air to the set of auxiliary blowers 12 is less advantageous. The early interruption of compressed air to the set of auxiliary blowers 13 is, for example, possible by making use of a measurement of the instant t18 and/or t19 and providing a period P25 as illustrated in FIG. 3. An early interruption of the supply of compressed air to the set of auxiliary blowers 17 is less desirable, as such a set of auxiliary blowers 17 should blow a relatively long time in order to ensure that a retracted weft thread is restretched and kept stretched once it has been restretched.

FIG. 1 also shows a thread monitor 49 near each prewinder 7, which thread monitor 49 sends a signal to the control unit 35 each time a winding 51 is unwound from a drum of a prewinder 7, more particularly each time a part of a weft thread arrives at or passes along the thread monitor 49. Such a thread monitor 49 is also referred to as a winding sensor. The signals from the thread monitors 49 are in this case transmitted to the control unit 35 by means of a connecting line 50. The measurements on the transported weft thread 4, 5 during transport of this weft thread 4, 5 are acquired here by the signals from the thread monitor 49. In this case, the instant when a winding 51 arrives at a thread monitor 49 is measured relative to a reference instant in the weaving cycle, more particularly what is known as a winding time. The successive signals of a thread monitor 49 can be used in the same manner as the successive signals of a respective thread monitor 18, 19 and 20. In addition, it is possible to determine or measure an absolute time for unwinding one or more windings.

Figure 6:
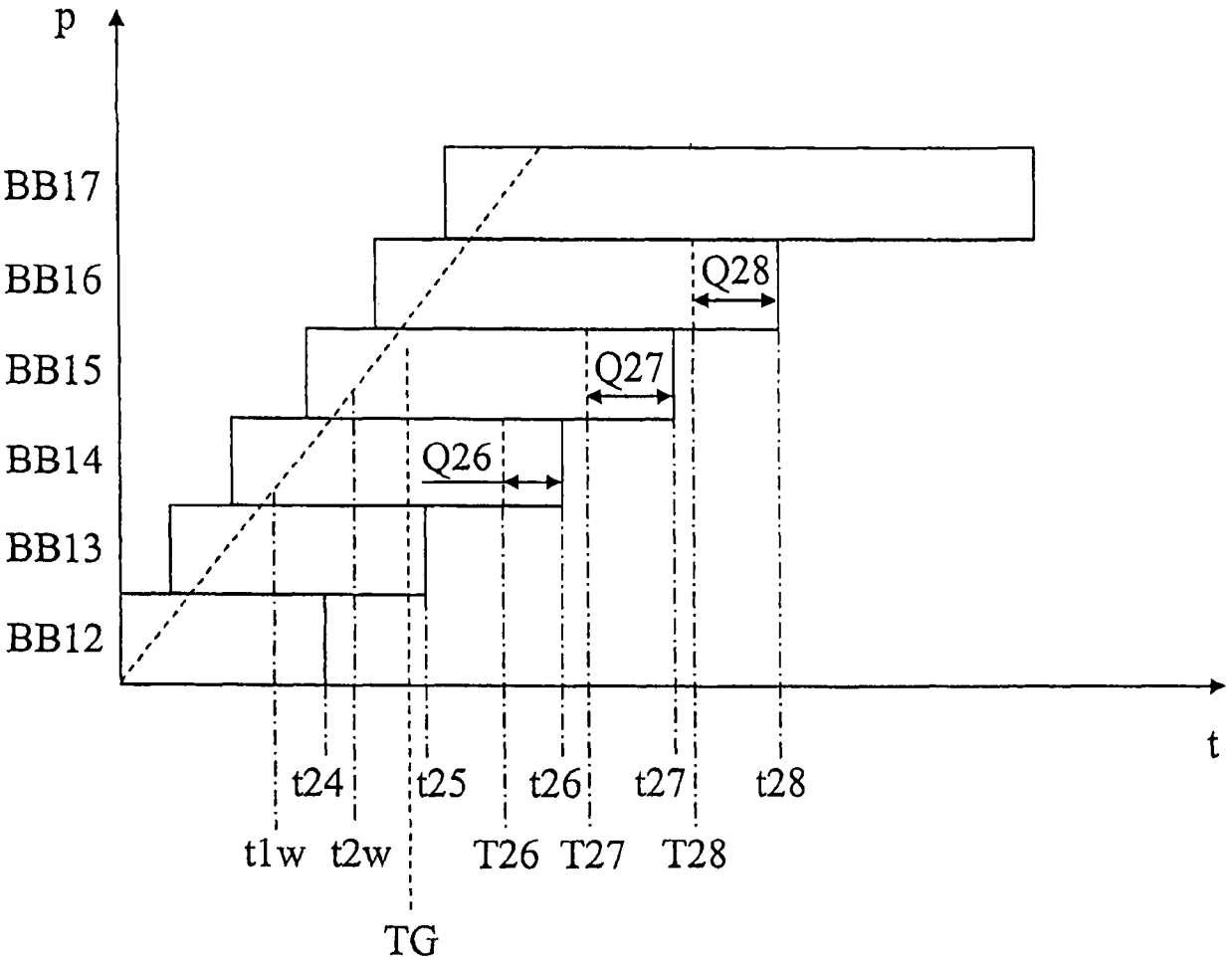

In case a weft thread has, for example, a length of five windings, the signal of, for example, the second winding t2*w*, in other words the second signal of the thread monitor 49, will be used in order to determine based on the signal t20, an instant T26, T27 or T28 in a manner similar to that illustrated in FIG. 3. In this case, the signal of the second winding t2*w*, as indicated in FIG. 6, can be used in a manner similar to the signal t20 in FIG. 3. The successive signals t1*w*, t2*w* of the thread monitor 49 can in this case be processed in a manner similar to the successive signals of the thread monitors 19 and 20 in order to control the interruption of the supply of compressed air to a specific set of auxiliary blowers.

According to one possibility, the instant of the signal of the second winding t2*w*, as illustrated in FIG. 6, is compared to a specific instant TG in the weaving cycle. This instant TG is a preset time or threshold value relative to a reference instant in the weaving cycle, for example a specific chosen time after the weaving machine has reached a specific angle position in the weaving cycle. If this measured instant or signal takes place before the instant TG then, as for example shown in FIG. 6, the instant of interruption of the supply of compressed air to a set of auxiliary blowers 14, 15 or 16 is advanced by a period Q26, Q27 or Q28. If this measured signal or instant t2*w* takes place after the instant TG, then the interruption of the supply of compressed air to a set of auxiliary blowers is not advanced, in other words, the supply of compressed air takes place in accordance with a predetermined flow, for example a flow such as illustrated in FIG. 2. The instant TG can be determined by the control unit 35, can be stored in the control unit 35 and can be adjusted and/or set during weaving by the control unit 35.

In order to determine a possibly wrong or inaccurate measurement of a winding time, for example the average winding time may be calculated. If the average winding time differs considerably from a predetermined value, it may be concluded that a winding time was measured wrongly. In the abovementioned example, for example, where the second winding time is used according to the invention, such a wrong measurement may occur when the first or second winding was not detected and thus an average winding time was obtained which is slightly greater than the expected average winding time. In this case, the method according to the invention is not used for this specific insertion of a weft thread, which means that the supply of compressed air to a set of auxiliary blowers is not interrupted early.

As indicated in FIG. 1, the weaving machine also comprises an input unit 52 which makes it possible to input not only a flow as indicated in FIG. 2, but also the parameters P25, P26, P27, P28 and/or Q26, Q27, Q28. It is clear that a plurality of said parameters may be input. According to one possibility, three sets of values are input for Q26, Q27 and Q28. For example a low value of 10 crank degrees, a medium value of 20 crank degrees and a high value of 30 crank degrees. According to one possibility, the values for Q26, Q27 and Q28 are for example selected to be identical in each case, more particularly they can be selected to be low, medium or high. The control unit 35 of the weaving machine can convert this number of crank degrees to a time value, for example, at 1200 insertions per minute, 360 crank degrees take 50 msec. Depending on the weft material to be woven, the operator of the weaving machine may input if a low, medium or high value is to be used with the method according to the invention.

Figure 7:
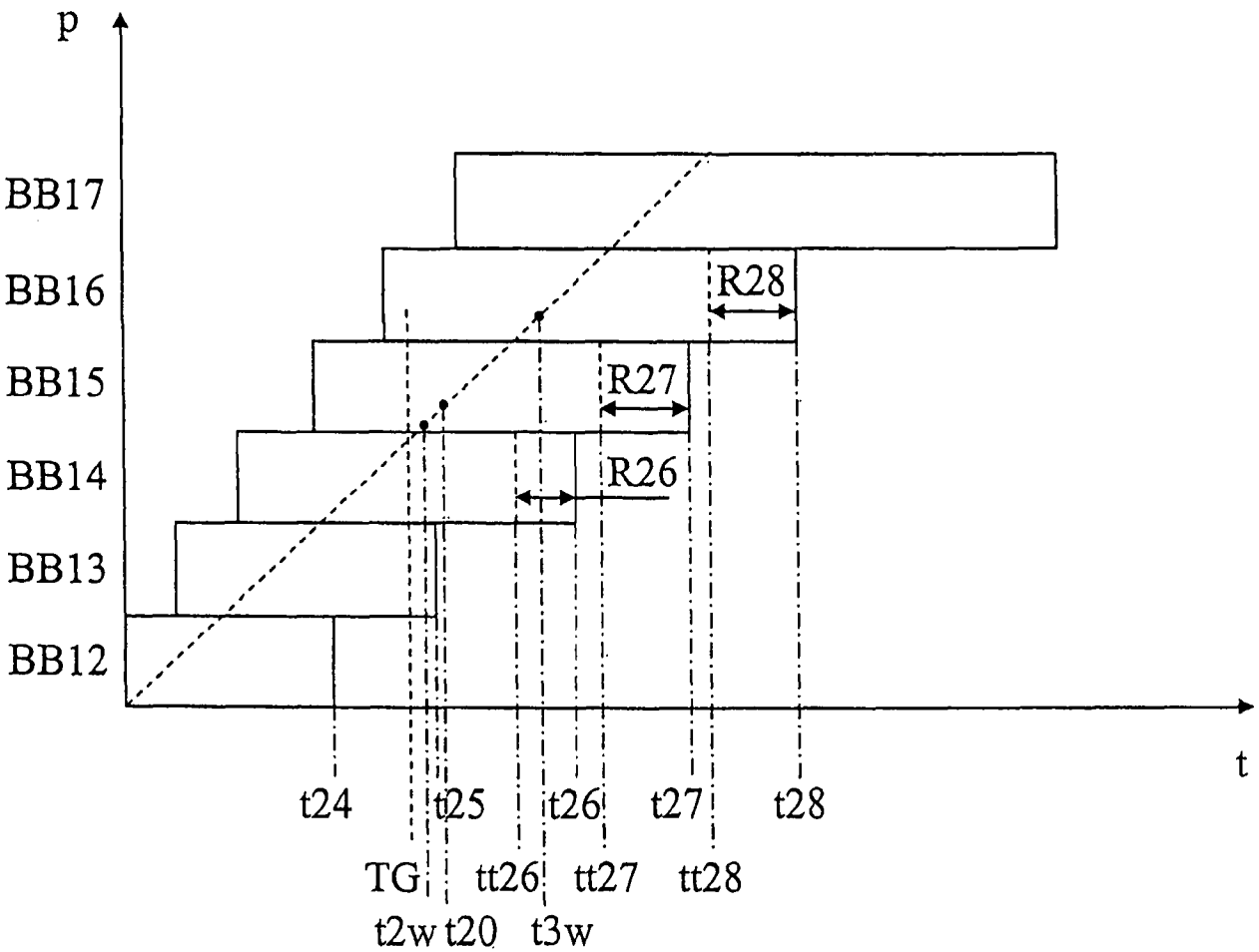

If weaving is carried out with a weaving machine which is set to a predetermined setting of instants and/or periods according to FIG. 2 and the method according to the invention is activated, it is not imperative to use a method as illustrated in FIGS. 3 to 6. According to a variant, when the method according to the invention is applied, the preset setting according to FIG. 2 is automatically adjusted to a new preset setting according to FIG. 7, with tt26, tt27 and tt28 taking place before t26, t27 and t28, respectively, in the weaving cycle, as indicated in FIG. 2. In this case, the supply of compressed air to the sets of auxiliary blowers 14, 15 and 16 is interrupted at instants tt26, tt27 and tt28, respectively. If it is, for example, found that t20 and/or the second winding time t2*w* take place after the instant TG, a switchover is effected to a predetermined flow for interrupting the supply of compressed air at instants t26, t27 or t28 in a manner similar to that illustrated in FIG. 2. In this case, the supply of compressed air is initially interrupted earlier during weaving and the supply of compressed air is only interrupted later when it has been determined that a relatively slow weft thread is transported through the shed. In this case, the period during which compressed air is supplied to a number of sets of auxiliary blowers during transport of a slow weft thread is extended. In both cases, the interruption takes place early if a weft thread reaches a certain position before the instant TG and the interruption takes place late if a weft thread reaches a certain position after the instant TG. Determining both t20 and t2*w* has the advantage that a wrong measurement for one of these values can be ruled out by determining the difference in time between these two values and comparing it to an expected or preset value.

It is clear that the time differences R26, R27 and R28 between tt26 and t26, between tt27 and t27 and between tt28 and t28, respectively, can be predetermined or preset. According to one embodiment, these values for the time differences R26, R27 and R28 can also be determined in relation to the period during which a set of auxiliary blowers is supplied with compressed air, for example as a percentage of this period. This means R26 is a percentage of the time difference between s26 and tt26, R27 a percentage of the time difference between s27 and tt27 and R28 a percentage of the time difference between s28 and tt28. This percentage can be selected to be low, medium or high, in other words, 10%, 20% or 30%, respectively. making use of a percentage is easy and makes it possible to input the setting in a simple manner.

It is also possible to select that relationship as a percentage which depends on the length of the period in which a set of auxiliary blowers is actuated. For a set of auxiliary blowers which is actuated during a relatively long period of time, for example, a percentage of 25% may be selected, while a percentage of 10% is selected for a set of auxiliary blowers which is actuated during a relatively short period of time. According to a variant, it is possible, for example, to select a percentage of 25% for the set of auxiliary blowers 16, while a percentage of 10% is selected for the sets of auxiliary blowers 14 and 15.

In the previous example, it is also possible to determine the time or the period by which the supply has to be extended based on the time difference between, for example the instant t20 and the instant TG, for example as a period equal to an amplification factor multiplied by the aforesaid time difference. It has been determined by means of tests that a value of one is suitable as amplification factor. According to another possibility, it is also possible to use a value of two, three or an even higher number, for example even a value of nine. In a similar manner, the instant TG can be compared to the instant t2*w* or t3*w*, during which for example the second or third winding is determined which passes along the thread monitor 49.

It is possible to achieve a good effect using the method according to the invention if an instant TG is selected which is virtually equal to the time it takes an average weft thread to arrive at or to pass along a specific thread monitor 20 or 49. The instant TG may, for example, be input via the input unit 52. However, it may be advantageous to allow the instant TG to be optimized by the control unit 35 or to be adjusted manually by the operator. Assuming that the flow for the supply of compressed air is adjusted. during the insertion for approximately 50% of the insertions means, for example, that the normal, predetermined flow, such as for example the flow from FIG. 2, is not used, but rather a modified flow based on measurements taken during the insertion, such as for example illustrated in one of FIGS. 3 to 7. This may result in the fact that for each insertion which is faster than an average insertion, the supply of compressed air will be interrupted sooner and for each insertion which is slower than an average insertion, the supply of compressed air will not be interrupted sooner. Tests have shown that the instant TG is best chosen such that, for between 30% and 50% of the insertions, the interruption in the supply of compressed air takes place earlier in the weaving cycle than for the other insertions. This means that it is possible to save a quantity of compressed air for 30% to 50% of the insertions. In this case, the method according to the invention works relatively well.

The control unit 35 can determine this percentage during weaving and display it by means of a display unit 53, so that the operator can check the instant TG manually and adjust it, if necessary. Of course, the control unit 35 can also adjust this instant TG automatically until this percentage is between 30% and 50%. The adjusted value for the instant TG can then be displayed on the display unit 53 together with the set value for the instant TG, so that the operator can check how the value for the instant TG has been adjusted or has changed.

According to one embodiment, the following method according to the invention can be used. First, it has to be decided whether a system is desired which will influence the interruption of the supply of compressed air to certain sets of auxiliary blowers to a small or large degree. The influence on the interruption of the supply can be selected to be limited, medium or large. With the example from FIG. 7, in which a predetermined setting of the instants and/or periods is selected whereby the periods are relatively short, the instant TG is, in the case of limited influence, for example set to 99.5% of the average time of t2*w* and an extension of 10% (time difference R26, R27 and R28) of the period for supplying compressed air is selected if t2*w* takes place later than the instant TG. If medium influence is aimed for, the instant TG may be set to 99% of the average time of t2*w* and the extension of the abovementioned period may be selected to be 20%. In case of a large influence, the instant TG may be selected to be 97% of the average time of t2*w* and the abovementioned period can in this case be extended by 30%.

According to a variant possibility, with a limited influence, the instant TG can be set to 99.5% of the abovementioned average time and the extension of the abovementioned period (time difference R26, R27 and R28) may be selected to be one time the time difference between t2*w* and TG. With a medium influence, the instant TG may be set to 99% of the abovementioned average time and the abovementioned extension may be selected to be, for example, three times the time difference between t2*w* and TG. With a strong influence, the instant TG may be set to 97% of the abovementioned average time and the abovementioned extension may be set to, for example, nine times the time difference between t2*w* and TG. Instead of one time, three times and nine times, it is also possible to set or select a different value as amplification factor. According to a variant possibility, each abovementioned period may be gradually extended in dependence of or in relation to the abovementioned time difference.

Figure 8:
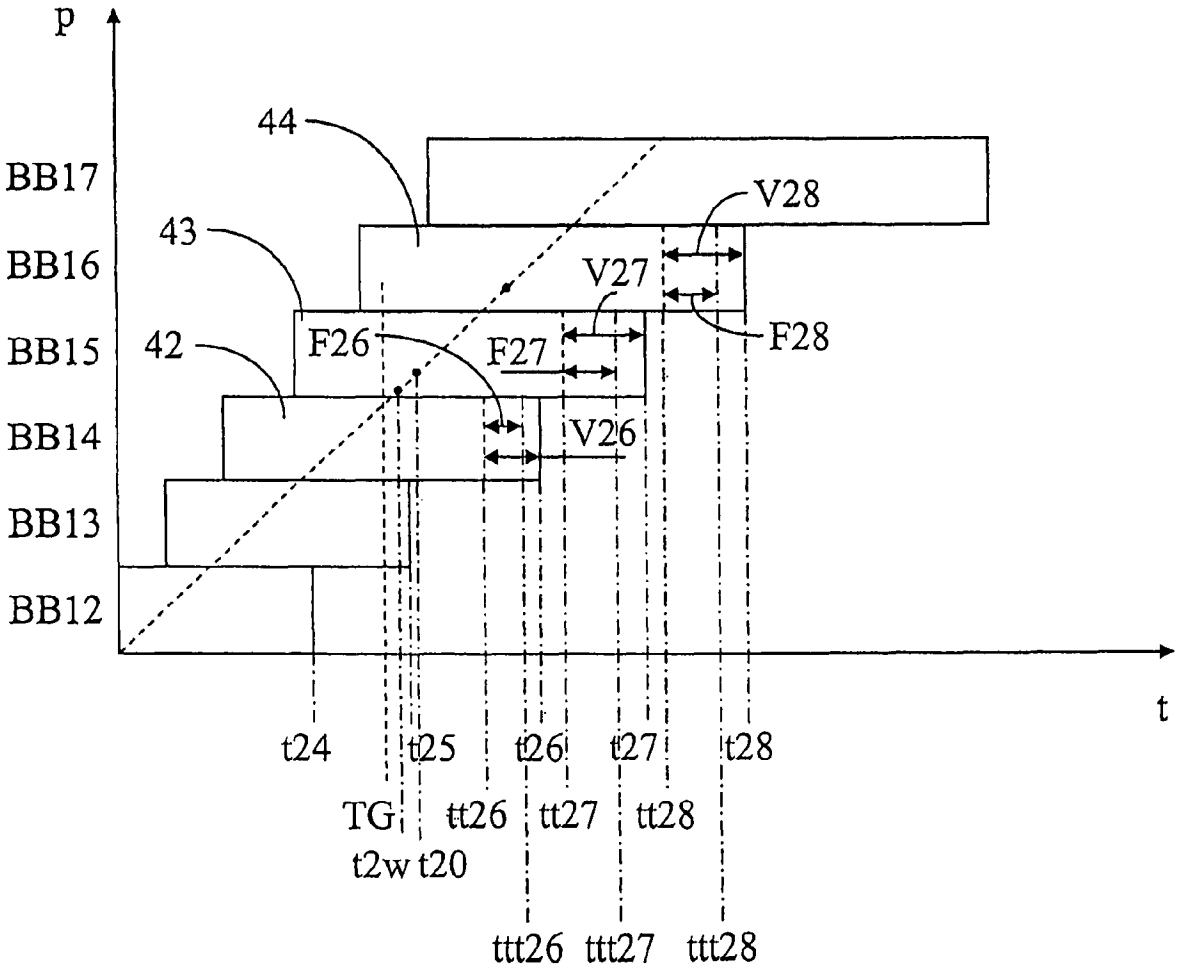

In addition to the abovementioned method and as indicated in FIG. 8, an extension of an abovementioned period, more particularly of a block 42, 43 or 44 by a time difference F26, F27 or F28 can take place. Such a time difference may be determined by multiplying an amplification factor and the time difference between, for example, t2*w* and TG. Of course, it is also possible to use a time difference between firstly TG and secondly an instant such as t1*w*, t3*w*, t19, t20 or another instant. An amplification factor can in this case, for example, be set for a specific speed of the weaving machine or the weaving cycle time. The amplification factor can, for example at 1200 revolutions/minute, be set at "1.5", "3" or "4.5" for a limited, medium or large influence, respectively. If weaving then takes place at a different speed, such an amplification factor is automatically adjusted by the control unit 35, for example inversely proportional to this speed. In the case of the illustrated example, this means that at 600 revolutions/minute, the amplification factor will be set to "3", "6" or "9", respectively, by the control unit 35. This has the advantage that an extension by a time difference F26, F27 or F28 of the blowing which results from a certain measured time difference, for example, the measured time difference between TG and t2*w*, will in this case result in an extension of the blowing which, at an identical measured time difference, will result in virtually an extension of the blowing which corresponds to virtually the number of crank degrees of the weaving machine. More particularly, if, for example at 600 revolutions/minute at a low influence, 1 msec too slow (after TG) is detected, then blowing is in this case extended by 3 msec, which in this case corresponds to approximately 12 crank degrees of the weaving machine. If the same measured time difference of 1 msec is determined at 1200 revolutions/minute, this will result in blowing being extended by only 1.5 msec, which will also correspond to approximately 12 crank degrees of the weaving machine. The amplification factor which is in this case adjusted as a function of the speed, can also be adjusted as a function of something else. A function of this type is thus not limited to an abovementioned inversely proportional function, but can also be adjusted in accordance with a different formula, which will for example result in a set of auxiliary blowers blowing longer for a number of crank degrees at a certain measured time difference.

As has furthermore been indicated in FIG. 8, a time difference V26, V27 and V28 is also used, which causes the supply of compressed air to be interrupted at instants t26, t27 or t28 virtually corresponding to those of FIG. 2. If, for example, F26 were to become greater than V26 in a manner as determined earlier, the extension is limited to V26. The value of F27 or F28 can be limited to the value of V27 and V28 in a similar manner. The latter, similarly to the embodiment of FIG. 4, offers the advantage that the periods can be extended according to a certain algorithm, but never become substantially longer than, for example, a setting as illustrated in FIG. 2. The extension of the abovementioned period has the advantage that a slow weft thread will cause the instants for interrupting the supply of compressed air to be adjusted. It is clear that according to a variant possibility, such an amplification factor which is a function of the speed of the weaving machine can be used in a similar manner to shorten the period for supplying compressed air.

Figure 9:
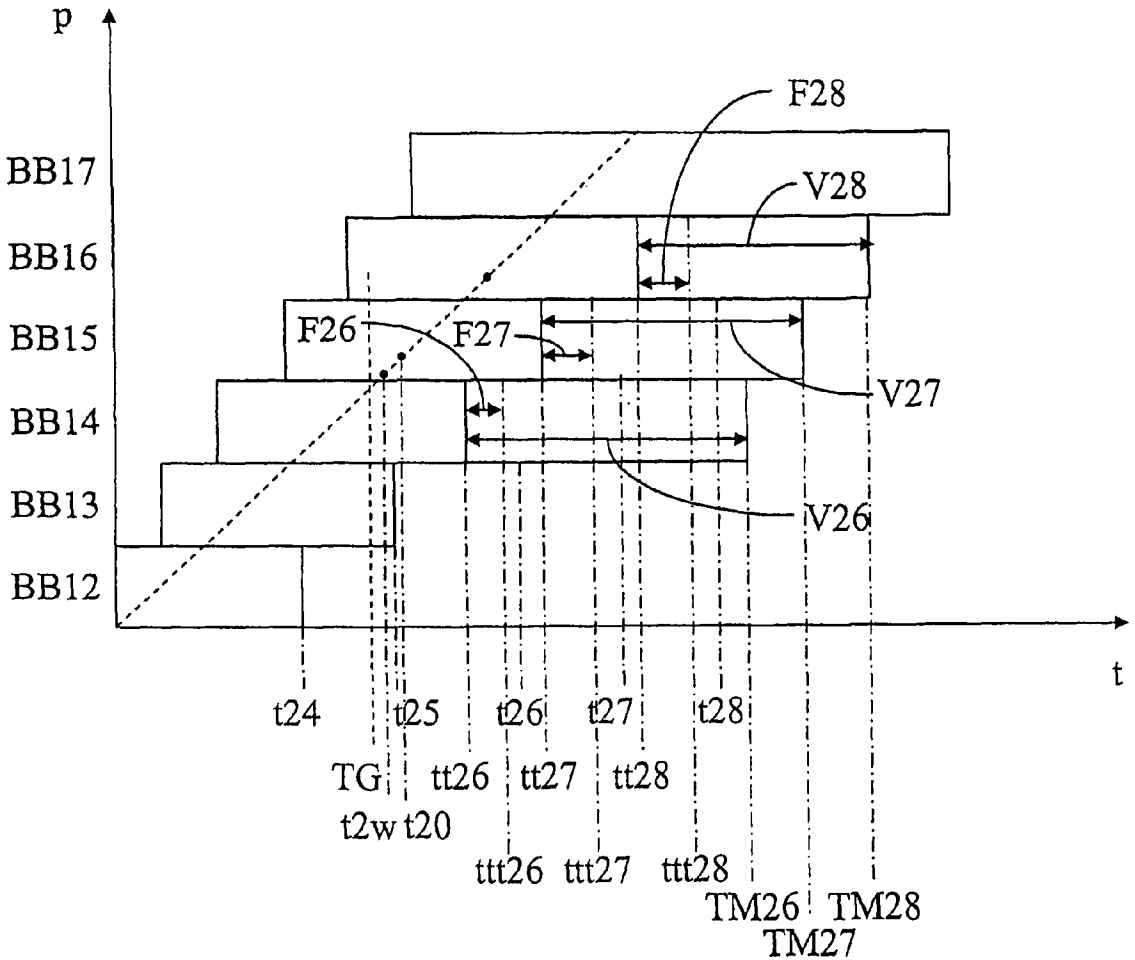

FIG. 9 shows another variant in which the values V26, V27 and V28 for limiting the time difference F26, F27 or F28, respectively, can be selected relatively arbitrarily. This makes it possible to allow the sets of auxiliary blowers to blow at the longest until the instant TM26, TM27 or TM28, respectively, is reached. This has the advantage that TM26, TM27 and TM28 can be selected later than t26, t27 or t28 in the example of FIG. 8, in other words, they are not directly related to t26, t27 or t28 of FIG. 2. This makes it possible to still weave with relatively slow weft threads. According to a variant possibility, it is possible, for example, to select the values of TM26, TM27 and TM28 to be equal to one another.

It is clear that, if it is decided to shorten the period, as indicated in FIG. 6, for example the instant TG can be set at 100.5% of the abovementioned average time at a limited influence, the instant TG can be set at 101% thereof at a medium influence and the instant TG can be set at 103% thereof at a strong influence. The values for Q26, Q27 and Q28 can of course be selected and/or set in a suitable manner.

It is clear that combinations of the abovementioned examples are likewise possible and form part of the description of the present invention. In this case, it is obviously possible to determine a suitable instant TG in relation to the average time when a weft thread arrives at a specific thread monitor by means of tests, so that a certain percentage of the insertions are woven with less compressed air. The operator or control unit 35 of the weaving machine can in this case check if the best results are achieved using a limited, medium or strong influence, in other words whether an amount of compressed air can be saved without this having a substantial effect on the transport and restretching of the weft thread.

According to the invention, the instant of the signals of the thread monitors 18, 19, 20, 34 and/or of the thread monitors 49 is measured and used in order to control the auxiliary blowers. In this case, unless for determining the instant TG, no direct use is made of averages over several introductions of weft threads, but only at least one measurement during the introduction of the weft thread itself is taken into consideration. This means that measurements during the insertion itself result in an optionally early interruption of the supply of compressed air. These measurements of instants when the relevant weft thread arrives at a thread monitor can, of course, be compared to the standard values which are stored in the control unit 35. Of course, it is also possible to determine averages in order to determine whether a measurement during an insertion is being carried out correctly and it is possible, for example in the case of an incorrect measurement, to adjust the result of this measurement, for example taking into account statistical formulae.

It is also clear that an individual flowchart for the supply of compressed air to successive auxiliary blowers may be provided for each type of weft thread 4, 5. The latter applies particularly if various weft threads are woven at a different weaving speed or transporting speed, more particularly when the speed of the weaving machine is adjusted to the weft thread to be introduced. In addition, a dedicated function may be provided for each type of weft thread 4,5 in order to determine whether to interrupt the supply of compressed air sooner or later based on the measurements on the introduced weft thread 4, 5 itself during the introduction of the latter. In this case, for example, each type of weft thread may be provided with compressed air in accordance with one of the embodiments according to FIGS. 3 to 7 or combinations thereof.

When applying the method according to the invention, it is advantageous to carry out as many measurements on the introduced weft thread as possible, for example carrying out both measurements using thread monitors 18, 19, 20 and 49 on the same weft thread. In this case, it is possible to detect a wrong measurement and to carry out an early or late interruption of the supply of compressed air to a set of auxiliary blowers only if the measurements indicate with a relatively large degree of certainty that it is a fast or slow weft thread. Controlling the instant when the supply of compressed air to one or more sets of auxiliary blowers is interrupted early or late during the introduction of a limited number of fast weft threads has the advantage that compressed air which does not contribute to the introduction of a weft thread and/or to the restretching of the weft thread can be saved and thus weaving can take place using less air.

It is clear that a set of auxiliary blowers may consist of at least one single auxiliary blower or a number of auxiliary blowers which are connected to a compressed-air source via a specific shut-off valve. The supply devices for compressed air to the main blowers, auxiliary blowers and stretching blowers are, of course, not limited to the shut-off valves, throttle valves and compressed-air source illustrated, but may be replaced by any supply device which can set, control or adjust the supply of compressed air. As is known from EP 442.546 B1, regulating the supply of compressed air to a main blower 8, 9 may, in a similar manner, consist of actuating the throttle valves 22 in such a way that each weft thread arrives, for example at a thread monitor 34, on average at the same instant in the weaving cycle. This means, for example, that, irrespective of changes in the properties of weft threads introduced successively, which may, for example, be the case with filament weft threads, the line 46 indicated in FIG. 2 for the movement path of an average weft thread does not change for subsequent weft threads. The above-mentioned regulation is of course not necessary when weaving spun weft threads where, as is known, the average movement path of weft threads introduced successively remains substantially unchanged. It is clear that a method for regulating the supply of compressed air to the main blowers may be carried out independently of the method according to the invention and that both methods virtually do not affect one another.

Although three kinds of influences are mentioned in the above description, namely a strong, medium or limited influence, it is clear that, according to a variant, only two kinds or even four or more kinds of influences may be provided, for example a very strong, strong, medium, limited and very limited influence.

Determining the instant TG in relation to an average instant when a weft thread arrives at a thread monitor 20, 49, is of course not limited to a percentage, but can also take place in accordance with another formula or statistically.

Figure 10:
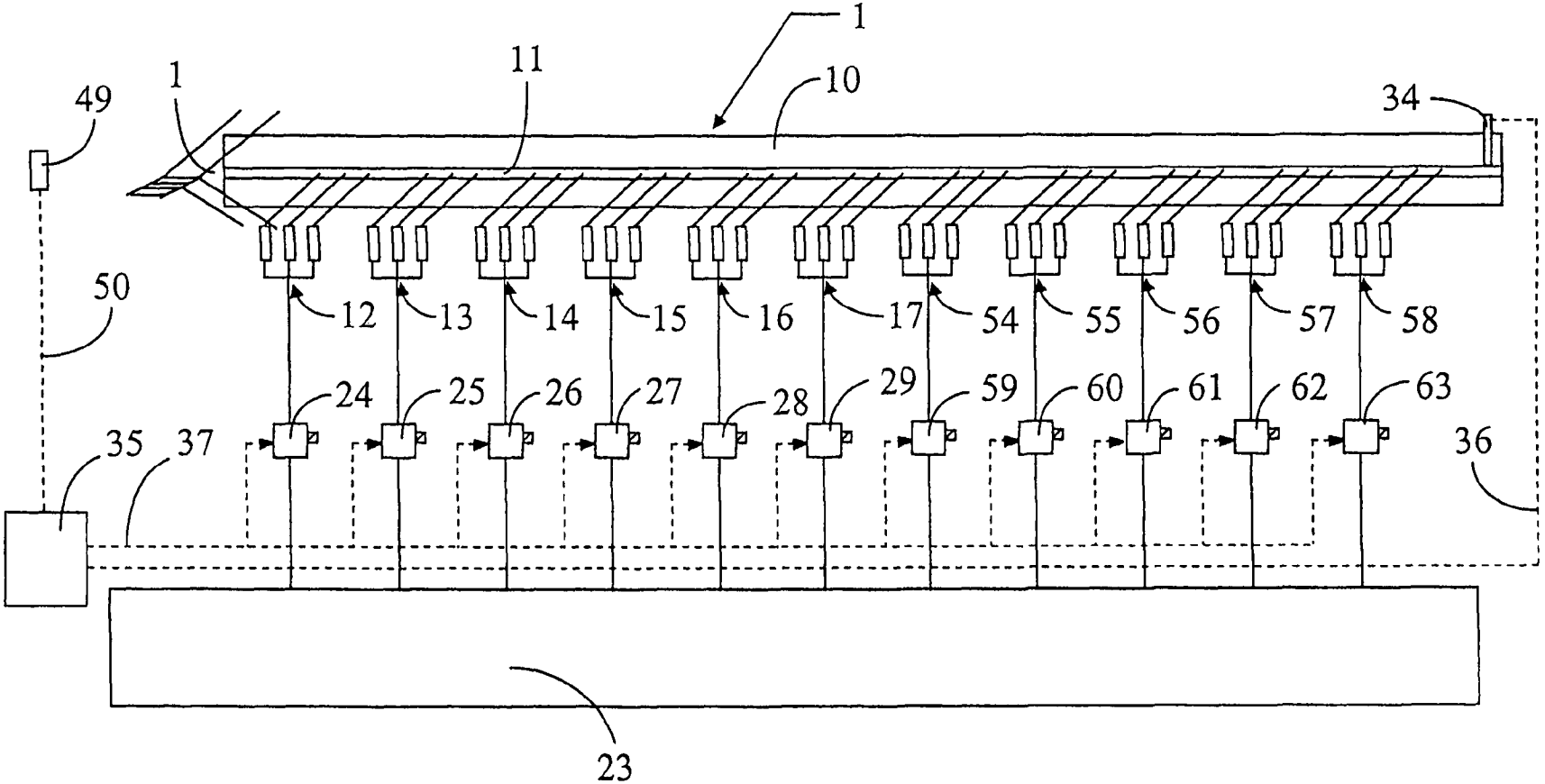
FIG. 10 diagrammatically shows a variant of a portion of the part of an air weaving machine from FIG. 1.
Figure 11:
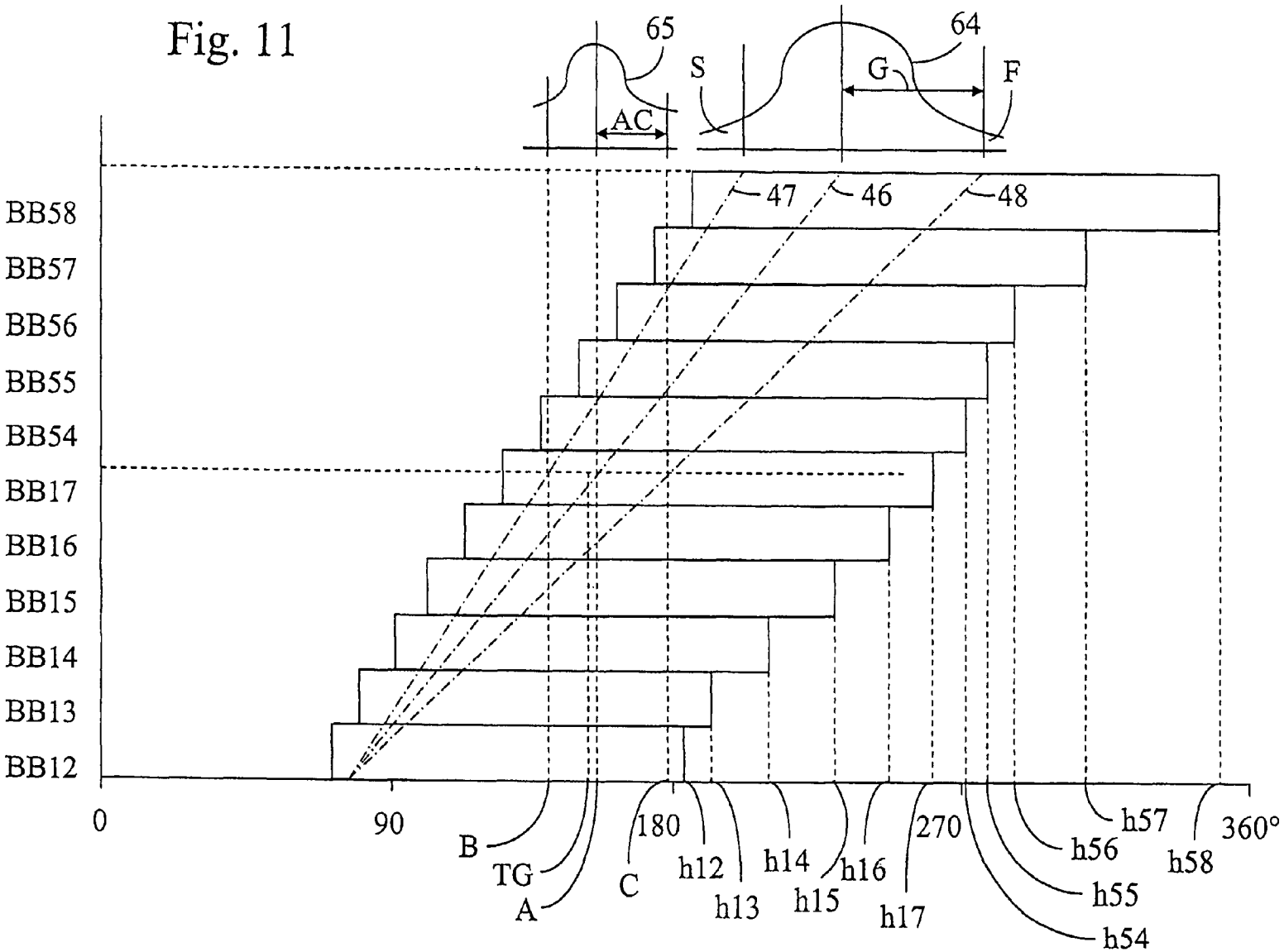
FIGS. 11 and 12 each show, inter alia, a flowchart for the supply of compressed air to successive sets of auxiliary blowers.

As diagrammatically indicated in FIG. 10, a plurality of successive sets of auxiliary blowers 12, 13, 14, 15, 16, 17, 54, 55, 56, 57 and 58 are shown, each of which is provided with compressed air via an associated shut-off valve 24, 25, 26, 27, 28, 29, 59, 60, 61, 62 and 63. An arrangement of this type is used, for example, with a relatively wide weaving machine. FIG. 11 shows a flowchart according to the prior art for the supply of compressed air to the above-mentioned successive sets of auxiliary blowers. This flowchart is expressed in crank degrees of the main shaft of the weaving machine. If the speed of the weaving machine is known, this flowchart can easily be converted to units time. However, the use of crank degrees is preferred, as in this case the control of the supply of compressed air to the sets of auxiliary blowers can take place independently of the speed of the weaving machine. This is particularly advantageous if successive insertions of weft threads take place at a different speed of the weaving machine, in other words if the speed of the weaving machine is not constant. As in FIG. 2, line 46 in this case illustrates the movement path of an average weft thread, line 47 that of a relatively fast weft thread and line 48 that of a relatively slow weft thread.

In addition, FIG. 11 shows a distribution 64 for the distribution of the instants of the arrival of successive weft threads at, for example, the thread monitor 34. By means of this distribution 64, a variation in these measurements may be determined. The supply of compressed air to the main blowers 8, 9 can be regulated in a known manner in such a way that an average weft thread arrives in accordance with line 46. The advantages of the present invention are used to better advantage if an average weft thread arrives at a thread monitor 34 at a relatively constant instant in the weaving cycle. In FIG. 11, the section S represents the weft threads which are faster than the relatively fast weft threads according to line 47 and the section F represents the weft threads which are slower than the relatively slow weft threads according to line 48. Particularly, section F and section S each have, for example, 3% to 5% of the number of weft threads introduced. It is clear that in practice, with a setting according to the prior art, the distribution 64 is measured or determined and that the lines 46, 47 and 48 are subsequently suitably determined as the theoretical path of an average weft thread, a relatively fast weft thread and a relatively slow weft thread, respectively.

It is preferable to determine a variation on measured instants with the thread monitor 34 since the instant that a weft thread reaches a thread monitor 34 which is arranged at the end of the shed, can be measured relatively accurately. A possible variation on these instants is indicated in FIG. 11 by G and is formed, for example, by the difference in arrival between a relatively slow weft thread, determined as mentioned above, and an average weft thread, determined as mentioned above. Such a variation G may be expressed as a angle difference or as a time difference at a certain weaving speed. Such a variation may also be determined in a different way, for example a variation of this type may be determined as a square average deviation of measured instants relative to an average instant, for instants which occur later than the average instant. According to another possibility, the variation may correspond to a factor times the statistical distribution at the abovementioned instants of arrival. In the embodiment of FIG. 11, the supply of compressed air to the successive sets of auxiliary blowers is interrupted at the instants h12 to h17 or h54 to h58, respectively.

In FIG. 11, A indicates a measured instant in the weaving cycle with an average weft thread, for example the instant when the third winding t3*w* is measured with a thread monitor 49, such as a winding sensor of a prewinder. In a similar manner, B represents an abovementioned instant with a relatively fast weft thread and C represents an abovementioned instant with a relatively slow weft thread. According to another possibility, the difference AC between the instants A and C can be used as variation. As can be seen in FIG. 11, the difference AC between the instants A and C is approximately half the value of G of the distribution 64. According to yet another possibility, such a variation can be determined statistically in the example illustrated by means of the distribution 65 for the distribution of the instants t3*w*. The distributions 64 and 65 and/or the lines 46, 47 and 48, on the basis of which the variation can be determined, can be determined during weaving of a large number of weft threads at a setting of the sets of auxiliary blowers in accordance with FIG. 11, for example a few thousand weft threads or all weft threads from a specific bobbin.

Figure 12:
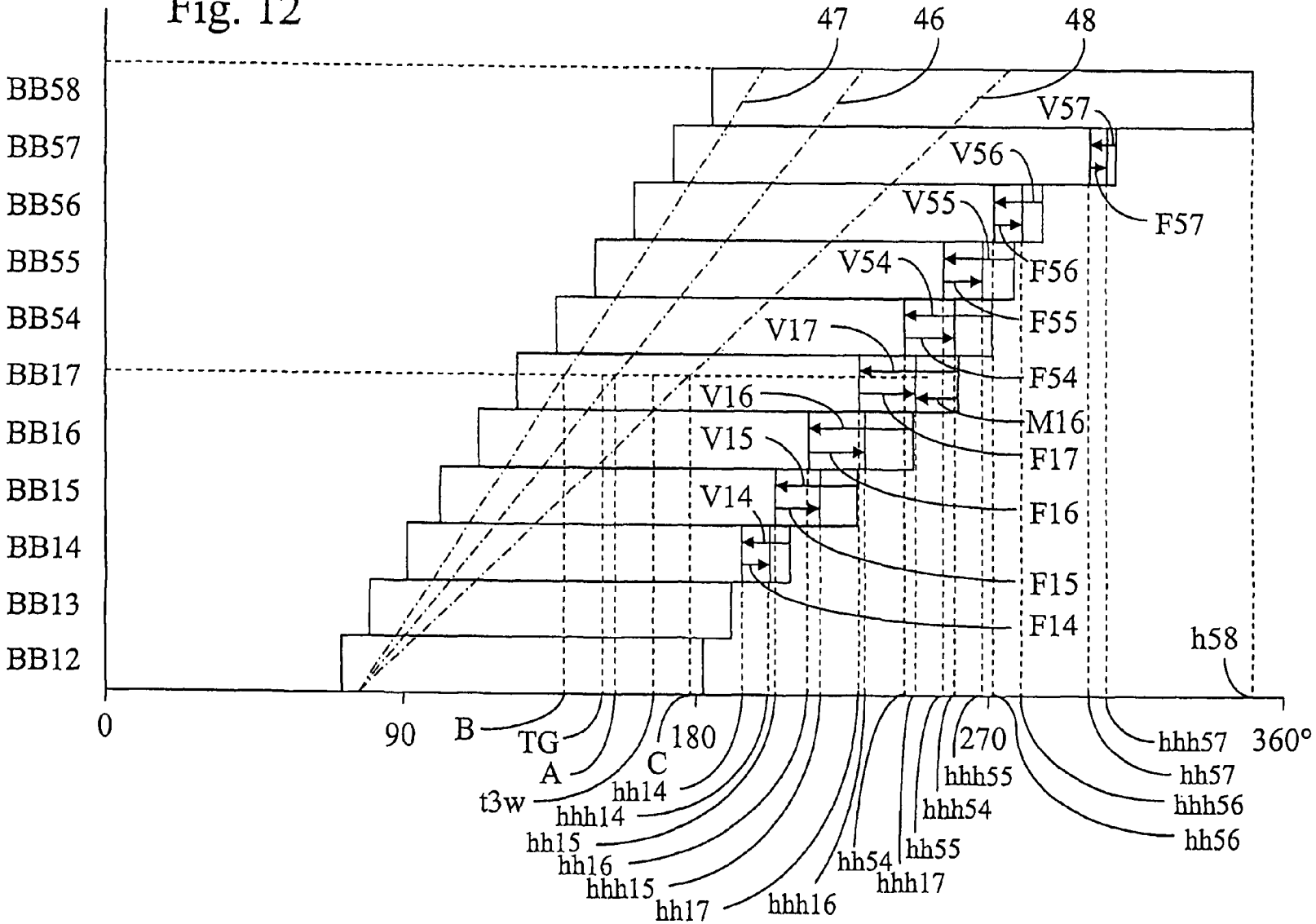

According to the invention, as illustrated in FIG. 12, with a weaving machine which was set in accordance with FIG. 11, by switching on the method according to the invention, the instants when the supply of compressed air to a number of sets of auxiliary blowers is interrupted or advanced by a period equal to a time difference or an angle difference V14, V15, V16, V17, V54, V55, V56 and V57 less a time difference or an angle difference F14, F15, F16, F17, F54, F55, F56 and F57. The time difference or angle difference F14, F15, F16, F17, F54, F55, F56 and F57 is determined based on measurements on the transported weft thread itself, which means that this time difference or angle difference is in each case determined anew during the introduction of the respective weft thread itself. The time difference or angle difference V14, V15, V16, V17, V54, V55, V56 and V57 is for example determined by means of a variation as mentioned above when the abovementioned method is switched on.

In the example of FIG. 12, similarly to the example in FIG. 8, the supply of compressed air, in case, in this example, t3*w* for example occurs sooner than TG, is interrupted early at instants hh14, hh15, hh16, hh17, hh54, hh55, hh56 and hh57 which occur before the instants h14, h15, h16, h17, h54, h55, h56 and h57, as illustrated in FIG. 11. If t3*w* in this case occurs after TG, the supply of compressed air is interrupted slightly later at instants hhh14, hhh15, hhh16, hhh17, hhh54, hhh55, hhh56 and hhh57, these instants being determined, for example, based on the difference between t3*w* and TG. In FIG. 12, the instant TG is selected to take place slightly before instant A.

The values for V14, V15, V16, V17, V54, V55, V56 and V57 are, for example, respectively defined as a factor times the value of G, more particularly as 0.3*G, 0.5*G, 0.7*G, 0.7*G, 0.5*G, 0.3*G, 0.2*G and 0.15*G, respectively. In the example illustrated, the values for F14, F15, F16, F17, F54, F55, F56 and F57 are respectively defined as an amplification factor Kx*(t3*w*−TG), with Kx being selected or set for each set of auxiliary blowers such that if t3*w* equals a value C, V14, V15, V16, V17, V54, V55, V56 and V57 equal F14, F15, F16, F17, F54, F55, F56 and F57, respectively. This offers the advantage that no amplification factor Kx has to be input and that the weaving machine can easily determine the amplification factor Kx for each set of auxiliary blowers without an operator having to intervene. In this case, it is still possible to select a low, medium or strong influence by selecting or calculating different values for V14, V15, V16, V17, V54, V55, V56 and V57 on the basis of an abovementioned variation. However, with the abovementioned exemplary embodiment, a value for F14, F15, F16, F17, F54, F55, F56 and F57 does not necessarily have to be limited to a value for V14, V15, V16, V17, V54, V55, V56 and V57. The latter means that if a specific weft thread t3*w* were to be later than C, that in this case, the supply of compressed air can be interrupted later than with a setting with an interruption of the supply of compressed air at instants h14 to h17 or h54 to h58 in a manner similar to the prior art. However, nothing prevents the values for F14, F15, F16, F17, F54, F55, F56 and F57 being limited to the values for V14, V15, V16, V17, V54, V55, V56 and V57, so that the supply of compressed air is interrupted at the latest at instants h14 to h17 or h54 to h58, in a manner similar to that illustrated in FIG. 11.

If the values for TG and/or C should change slightly during weaving, it will be clear that in this case the amplification factor Kx which is associated with a respective set of auxiliary blowers can also be adjusted or changed. According to the method according to the invention, if an abovementioned variation G should change during weaving, the values for V14 to V17 and V54 to V57 and/or the values for F14 to F17 and F54 to F57 can also be adjusted.

In the example of FIG. 12, the supply of compressed air to certain sets of auxiliary blowers is not interrupted early, for example because the command to interrupt the supply of compressed air may occur before the instant of deciding whether or not to interrupt early. In the example illustrated, this applies to the sets of auxiliary blowers 12 and 13, as a measurement t3*w* may sometimes have been carried out too late in order to achieve an early interruption of the supply of compressed air to those sets of auxiliary blowers 12 and 13. The supply of compressed air to the set of auxiliary blowers 58 is also not interrupted early in order not to adversely affect stretching and restretching of a weft thread. According to the invention, most compressed air can be saved by interrupting the sets of auxiliary blowers which are arranged approximately near the middle of the shed more early than the sets of auxiliary blowers outside of the middle. In the illustrated example of FIG. 12, this means that the supply of compressed air to the sets of auxiliary blowers 16 and 17 is interrupted more early than that to the other sets of auxiliary blowers.

In the example shown, the supply of compressed air to the sets of auxiliary blowers 12 and 13 is not interrupted early. If, for example, the speed of the weaving machine is selected to be relatively high, the result of this may be that the supply of compressed air to at least one subsequent set of auxiliary blowers 14 cannot be interrupted more early either. This is caused by the fact that it takes a certain amount of time to close the shut-off valves, which time is more critical at a higher weaving speed.

It is clear that according to a variant, the interruption of the supply of compressed air can also be determined on the basis of, for example, the difference between, for example, t3*w* and the value C in case t3*w* occurs after TG. As indicated in FIG. 12, it is possible in this way to determine a value M16 as Kx*(C—t3*w*) during the introduction of a weft thread for the set of auxiliary blowers 16. In this case, the value for Kx which is associated with an associated set of auxiliary blowers can be determined as mentioned above. It is clear that M16 in this case equals the difference between V16 and F16. In this case, the value M16 can be limited to the value V16 in FIG. 12 if t3*w* occurs before TG. In a similar manner, the other values M14 to M57 can be determined for the other sets of auxiliary blowers, these other values M14 to M57 not being indicated in FIG. 12 for the sake of clarity.

The method according to the invention has the advantage that, irrespective of the type of weft thread and of a variation in the measurements on a plurality of transported weft threads during transport of these weft threads, it is possible to achieve the interruption of the supply of compressed air to at least one set of auxiliary blowers in an optimum manner, so that the air consumption is suitably reduced.

It is clear that the air weaving machine is not limited to an air weaving machine in which a weft thread is blown into a guide passage 11 by means of compressed air. The sets of auxiliary blowers of the air weaving machine can also blow onto a holder for a weft thread which transports a weft thread through the shed. In addition, instead of standard compressed air, any desired fluid can be used for introducing a weft thread in a shed of a weaving machine of this type. In this case, it is also possible to use standard compressed air mixed with a gas, a liquid or a vapor.

It is clear, that despite the fact that the present description mentions time, this time can also be expressed in crank degrees of the weaving machine. In this case, one crank degree of the weaving machine corresponds, for example, to a number of milliseconds or one millisecond corresponds to a number of crank degrees.

The method and the air weaving machine according to the invention presented in the claims are not restricted to the exemplary embodiments which have been illustrated and described, but rather may also encompass variants and combinations thereof which are within the scope of the claims.

The invention claimed is:

1. A method for controlling the consumption of air during transport of an inserted weft thread through the shed of an air weaving machine using a plurality of sets of auxiliary blowers disposed along the shed for transporting each weft thread by pressurized air flow and wherein the blowing times of pressurized air supplied to each auxiliary blower set are controlled by a weaving machine controller to control the movement of each weft thread during each weft insertion according to pre-set parameters, said pre-set parameters causing each respective auxiliary blower set to be actuated for transporting a slow weft thread through the shed, comprising determining the position of each inserted weft thread relative to the location of at least one auxiliary blower set using at least one weft thread winding or position sensor in communication with the controller and interrupting the supply of air to said at least one auxiliary blower set as a function of when the weft thread will reach or pass or actually reaches or passes said at least one auxiliary blower set, said interruption step including causing said controller to interrupt the supply of air to said at least one auxiliary blower set without affecting the speed of transport of the weft thread, but only interrupting the blowing of air by said at least one auxiliary blower set at an instant in time after said at least one blower set has blown against a respective inserted weft thread and when a fast weft thread is detected before the moment at which such blowing would end in accordance with said pre-set parameters, whereas when a slow weft thread is detected the auxiliary blowers are actuated according to said pre-set parameters.

2. The method according to claim 1, including determining a first time interval taken or expected to be taken from the time of insertion for each inserted weft thread to reach the location of said at least one auxiliary blower set relative to a pre-set second time interval (TG) in a respective weaving cycle and causing the controller to interrupt the supply of air to said at least one auxiliary blower set a third predetermined and/or variable time interval before the moment at which blowing would end in accordance with said pre-set parameters, said third predetermined time interval being determined as a function of a difference between said first and second time intervals.

3. The method according to claim 2, including selecting said second time interval (TG) to correspond with or be related to an average first time interval among plural weft thread insertions.

4. The method according to claim 3, including selecting said second time interval (TG) so as to result in a time interval that is related to a selected percentage of average first time intervals among plural weft thread insertions.

5. The method according to claim 1, including determining a first time interval taken or expected to be taken from the time of insertion for each inserted weft thread to reach the location of said at least one auxiliary blower set relative to a pre-set second time interval (TG) in a respective weaving cycle and causing the controller to interrupt the supply of air to said at least one auxiliary blower set a third predetermined and/or variable time interval before the moment at which blowing would end in accordance with said pre-set parameters, said third predetermined time interval being determined as a function of a blowing time of said at least one blower set according to said pre-set parameters.

6. The method according to claim 2, including varying said third predetermined time interval as a function of speed of the weaving machine.

7. The method according to any one of claim 2, 3, 4 or 5, including determining said first, second and third time intervals as a function of weaving machine crank angle.

8. A method for controlling the consumption of air during transport of an inserted weft thread through the shed of an air weaving machine using a plurality of sets of auxiliary blowers disposed along the shed for transporting each weft thread by pressurized air flow and wherein the blowing times of pressurized air supplied to each auxiliary blower set are controlled by a weaving machine controller to control the movement of each weft thread during each weft insertion according to pre-set parameters, said pre-set parameters causing the respective auxiliary blower set to be actuated for transporting a fast weft thread through the shed, comprising:

determining the position of each inserted weft thread relative to the location of at least one auxiliary blower set using at least one weft thread winding or position sensor in communication with the controller and interrupting the supply of air to said at least one auxiliary blower set as a function of when the weft thread will reach or pass or actually reaches or passes said at least one auxiliary blower set, said interruption step including causing said controller to interrupt the supply of air to said at least one auxiliary blower set without affecting the speed of transport of the weft thread, but only interrupting the blowing of air by said least one auxiliary blower set at an instant in time after said at least one blower set has blown against a respective inserted weft thread and when a slow weft thread is detected after the moment at which such blowing would end in accordance with said pre-set parameters, whereas when a fast weft thread is detected the auxiliary blowers are actuated according to said pre-set parameters.

9. The method according to claim 8, including determining a first time interval taken or expected to be taken from the time of insertion for each inserted weft thread to reach the location of said at least one auxiliary blower set relative to a pre-set second time interval (TG) in the respective weaving cycle and causing the controller to interrupt the supply of air to said at least one auxiliary blower set a third predetermined and/or variable time interval after the moment at which blowing would end in accordance with said pre-set parameters, said third predetermined time interval being determined as a function of a difference between said first and second time intervals.

10. The method according to claim 9, including selecting said second time interval (TG) to correspond with or be related to an average first time interval among plural weft thread insertions.

11. The method according to claim 10, including selecting said second time interval (TG) so as to result in a time interval that is related to a selected percentage of average first time intervals among plural weft thread insertions.

12. The method according to claim 8, including determining a first time interval taken or expected to be taken from the time of insertion for each inserted weft thread to reach the location of said at least one auxiliary blower set relative to a pre-set second time interval (TG) in a respective weaving cycle and causing the controller to interrupt the supply of air to said at least one auxiliary blower set a third predetermined and/or variable time interval after the moment at which blowing would end in accordance with said pre-set parameters, said third predetermined time interval being determined as a function of a blowing time of said at least one blower set according to said pre-set parameters.

13. The method according to claim 9, including varying said third predetermined time interval as a function of speed of the weaving machine.

14. The method according to any one of claim 8, 9, 10 or 11, including determining said first, second and third time intervals as a function of weaving machine crank angle.

15. A method for controlling the consumption of air during transport of an inserted weft thread through the shed of an air weaving machine using a plurality of sets of auxiliary blowers disposed along the shed for transporting each weft thread by pressurized air flow and wherein the blowing times of pressurized air supplied to each auxiliary blower set are controlled by a weaving machine controller to control the movement of each weft thread during each weft insertion according to pre-set parameters, said pre-set parameters causing each respective auxiliary blower set to be actuated for transporting an average weft thread through the shed, comprising determining the position of each inserted weft thread relative to the location of at least one auxiliary blower set using at least one weft thread winding or position sensor in communication with the controller and interrupting the supply of air to said at least one auxiliary blower set as a function of when the weft thread will reach or pass or actually reaches or passes said at least one auxiliary blower set, said interruption step including causing said controller to interrupt the supply of air to said at least one auxiliary blower set without affecting the speed of transport of the weft thread, but only interrupting the blowing of air by said at least one auxiliary blower set at an instant in time after said at least one blower set has blown against a respective inserted weft thread and, in the case when a fast weft thread is detected, before the moment at which such blowing would end in accordance with said pre-set parameters; in the case when a slow weft thread is detected, after the moment at which such blowing would end in accordance with said pre-set parameters; and in the case when an average weft thread is detected, actuating the auxiliary blowers according to said pre-set parameters.

16. The method according to claim 15, including determining a first time interval taken or expected to be taken from the time of insertion for each inserted weft thread to reach the location of said at least one auxiliary blower set relative to a pre-set second time interval (TG) in a respective weaving cycle and causing the controller to interrupt the supply of air to said at least one auxiliary blower set a third predetermined and/or variable time interval before or after the moment at which blowing would end in accordance with said pre-set parameters, said third predetermined time interval being determined as a function of a difference between said first and second time intervals.

17. The method according to claim 16, including selecting said second time interval (TG) to correspond with or be related to an average first time interval among plural weft thread insertions.

18. The method according to claim 17, including selecting said second time interval (TG) so as to result in a time interval that is related to a selected percentage of average first time intervals among plural weft thread insertions.

19. The method according to claim 15, including determining a first time interval taken or expected to be taken from the time of insertion for each inserted weft thread to reach the location of said at least one auxiliary blower set relative to a pre-set second time interval (TG) in a respective weaving cycle and causing the controller to interrupt the supply of air to said at least one auxiliary blower set a third predetermined and/or variable time interval before or after the moment at which blowing would end in accordance with said pre-set parameters, said third predetermined time interval being determined as a function of a blowing time of said at least one blower set according to said pre-set parameters.

20. The method according to claim 16, including varying said third predetermined time interval as a function of speed of the weaving machine.

21. The method according to any one of claim 16, 17, 18 or 19, including determining said first, second and third time intervals as a function of weaving machine crank angle.

22. An air weaving machine comprising one or more auxiliary blower sets; a controller for controlling the blowing times of the blower set or sets during each weft thread insertion during weaving in accordance with pre-set parameters; winding or weft sensors arranged to determine the position of each inserted weft thread relative to the or at least one auxiliary blower set and to communicate signals indicative of said position to said controller; wherein said controller is arranged to carry out the method of claim 1, 8 or 15 to reduce said blowing times of the or at least one auxiliary blower set to reduce air consumption by the weaving machine without affecting the transport speed of the inserted weft threads.

* * * * *